US005438244A

United States Patent [19]

Chang

[11] Patent Number: 5,438,244

[45] Date of Patent: Aug. 1, 1995

[54] USE OF SILVER AND NICKEL SILICIDE TO CONTROL IODINE LEVEL IN ELECTRODELESS HIGH INTENSITY DISCHARGE LAMPS

[75] Inventor: Hsueh-Rong Chang, Schenectady, N.Y.

[73] Assignee: General Electric Company, Schenectady, N.Y.

[21] Appl. No.: 298,966

[22] Filed: Sep. 2, 1994

[51] Int. Cl.[6] ..... H05B 41/16

[52] U.S. Cl. ..... 315/248; 315/344; 313/553; 313/637; 313/638

[58] Field of Search ..... 315/248, 344, 111.21, 315/56, 39; 313/630, 635, 637, 638, 640, 553; 437/230

[56] References Cited

U.S. PATENT DOCUMENTS

| | | | |
|---|---|---|---|
| 3,746,944 | 7/1973 | Naraoka et al. | 317/234 R |
| 3,781,586 | 12/1973 | Johnson | 313/174 |
| 4,170,746 | 10/1979 | Davenport | 315/246 |
| 4,812,702 | 3/1989 | Anderson | 315/248 X |
| 4,972,120 | 11/1990 | Witting | 313/638 |
| 5,032,762 | 7/1991 | Spacil et al. | 313/635 |
| 5,057,751 | 10/1991 | Witting et al. | 315/248 |
| 5,075,259 | 12/1991 | Moran | 437/230 |
| 5,136,214 | 8/1992 | Roberts et al. | 315/248 |
| 5,187,412 | 7/1993 | El-Hamamsy et al. | 315/248 |
| 5,343,118 | 8/1994 | Chang | 315/248 X |

*Primary Examiner*—Robert J. Pascal
*Assistant Examiner*—Haissa Philogene
*Attorney, Agent, or Firm*—Jill M. Breedlove; Marvin Snyder

[57] ABSTRACT

Silver metal and nickel silicide are added to the fill of an electrodeless high intensity metal halide discharge lamp, which includes at least one metal iodide as a fill ingredient, for controlling the iodine vapor level therein. The nickel silicide acts to getter oxygen which has been introduced into the arc tube during lamp processing, thereby avoiding oxidation of the metal iodide portion of the fill and a concomitant release of free iodine into the arc tube. The silver acts to getter free iodine available from the metal iodide(s) of the fill as metal diffuses into the quartz arc tube wall, forming silver iodide (AgI). The combination of silver and nickel silicide acts to control the iodine level below an arc instability threshold to promote and maintain arc stability. In addition, neither silver nor nickel silicide attack the quartz arc tube wall. Lamp performance and lamp life are thus substantially improved.

6 Claims, 2 Drawing Sheets

USE OF SILVER AND NICKEL SILICIDE TO CONTROL IODINE LEVEL IN ELECTRODELESS HIGH INTENSITY DISCHARGE LAMPS

FIELD OF THE INVENTION

The present invention relates generally to high intensity metal halide discharge lamps and, more particularly, to the use of silver and nickel silicide in metal halide discharge lamps for controlling the iodine vapor level therein and thereby promoting arc stability and improving lamp performance.

BACKGROUND OF THE INVENTION

In operation of a high intensity metal halide discharge lamp, visible radiation is emitted by the metal portion of the metal halide fill at relatively high pressure upon excitation typically caused by passage of current therethrough. One class of high intensity metal halide lamps comprises electrodeless lamps which generate an arc discharge by establishing a solenoidal electric field in the high-pressure gaseous lamp fill comprising the combination of one or more metal halides and an inert buffer gas. In particular, the lamp fill, or discharge plasma, is excited by radio frequency (RF) current in an excitation coil surrounding an arc tube which contains the fill. The arc tube and excitation coil assembly acts essentially as a transformer which couples RF energy to the plasma. That is, the excitation coil acts as a primary coil, and the plasma functions as a single-turn secondary. RF current in the excitation coil produces a time-varying magnetic field, in turn creating an electric field in the plasma which closes completely upon itself, i.e., a solenoidal electric field. Current flows as a result of this electric field, producing a toroidal arc discharge in the arc tube.

Typical electrodeless metal halide discharge lamps use metal halides (e.g., including at least one metal iodide) for generating white color lamp emission for general lighting applications. Disadvantageously, however, free iodine formation and devitrification of the arc tube wall occur in electrodeless high intensity metal halide discharge lamps after exposure to the plasma arc discharge. The amount of free iodine in the arc tube increases with time. This accumulating iodine, beyond a certain threshold, causes arc instability and eventual arc extinction.

Accordingly, it is desirable to control the iodine level in electrodeless high intensity metal halide discharge lamps and thereby promote arc stability, while extending lamp life and improving lamp performance.

SUMMARY OF THE INVENTION

Silver metal and nickel silicide are added to the fill of an electrodeless high intensity metal halide discharge lamp, which includes at least one metal iodide as a fill ingredient, for controlling the iodine vapor level therein. In operation, the nickel silicide acts to getter oxygen which has been introduced into the arc tube during lamp processing, thereby avoiding oxidation of the metal iodide portion of the fill and a concomitant release of free iodine into the arc tube. The silver acts to getter free iodine available from the metal iodide(s) of the fill as metal diffuses into the quartz arc tube wall, forming silver iodide (AgI). Hence, by using silver as an iodine getter and nickel silicide as an oxygen getter, the iodine level is controlled below an arc instability threshold to promote and maintain arc stability. In addition, neither silver nor nickel silicide attack the quartz arc tube wall. Lamp performance and life are thus substantially improved.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
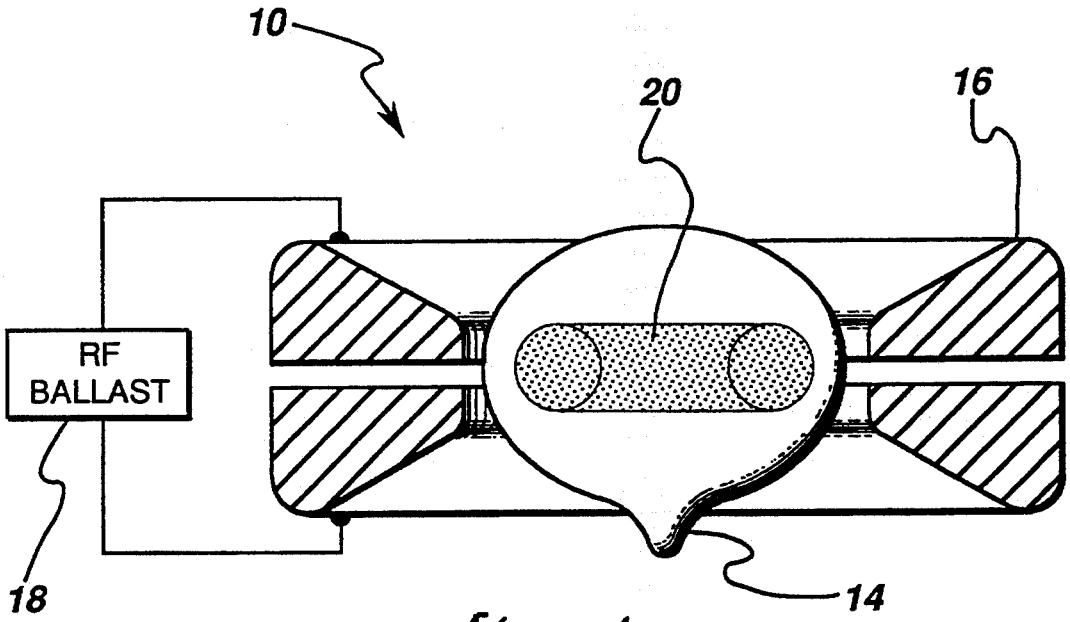
FIG. 1 is a partially schematic and partially cross sectional illustration of a typical electrodeless high intensity metal halide discharge lamp.

FIG. 1 illustrates a typical electrodeless high intensity metal halide discharge lamp 10. As shown, lamp 10 includes an arc tube 14 formed of a high temperature glass, such as fused silica. By way of example, arc tube 14 is shown as having a substantially ellipsoid shape. However, arc tubes of other shapes may be desirable, depending upon the application. For example, arc tube 14 may be spherical or may have the shape of a short cylinder, or "pillbox", having rounded edges, if desired Arc tube 14 contains a metal halide fill, including at least one metal iodide, in which a solenoidal arc discharge is excited during lamp operation. A suitable fill comprises at least one rare earth metal halide (e.g., cerium iodide ($CeI_3$), lanthanum iodide ($LaI_3$), neodymium iodide ($NdI_3$), praeseodymium iodide ($PrI_3$)) and at least one alkali metal halide (e.g., sodium iodide (NaI), cesium iodide (CsI) and lithium iodide (LiI). One exemplary fill comprises sodium iodide, cerium iodide and xenon combined in weight proportions to generate visible radiation exhibiting high efficacy and good color rendering capability at white color temperatures. Such a fill is described in commonly assigned U.S. Pat. No. 4,810,938 of P. D. Johnson, J. T. Dakin and J. M. Anderson, issued on Mar. 7, 1989 and incorporated by reference herein. Another exemplary fill comprises a combination of lanthanum iodide ($LaI_3$), sodium iodide (NaI), cerium iodide cerium iodide ($CeI_3$), and xenon, as described in commonly assigned U.S. Pat. No. 4,972,120 of H. L. Witting, issued Nov. 20, 1990 and incorporated by reference herein. Still another exemplary fill comprises sodium iodide (NaI), rhenium iodide ($ReI_3$), and xenon.

Electrical power is applied to lamp 10 by an excitation coil 16 disposed about arc tube 14 which is driven by an RF signal via a ballast 18. A suitable excitation coil 16 may comprise, for example, a two-turn coil having a configuration such as that described in commonly assigned U.S. Pat. No. 5,039,903 of G. A. Fartall, issued Aug. 13, 1991 and incorporated by reference herein. Such a coil configuration results in very high efficiency and causes only minimal blockage of light from the lamp. The overall shape of the excitation coil of the Farrall patent is generally that of a surface formed by rotating a bilaterally symmetrical trapezoid about a coil center line situated in the same plane as the trapezoid, but which line does not intersect the trapezoid. However, other suitable coil configurations may be used, such as that described in commonly assigned U.S. Pat.

No. 4,812,702 of J. M. Anderson, issued Mar. 14, 1989 and incorporated by reference herein. In particular, the Anderson patent describes a coil having six turns which are arranged to have a substantially V-shaped cross section on each side of a coil center line. Still another suitable excitation coil may be of solenoidal shape, for example.

In operation, RF current in coil 16 results in a time-varying magnetic field which produces within arc tube 14 an electric field that completely closes upon itself. Current flows through the fill within arc tube 14 as a result of this solenoidal electric field, producing a toroidal arc discharge 20 in arc tube 14. The operation of an exemplary electrodeless high intensity discharge lamp is described in Johnson et al. U.S. Pat. No. 4,810,938, cited hereinabove.

In accordance with the present invention, appropriate quantities of silver and nickel silicide are added to the metal iodide fill of an electrodeless high intensity discharge lamp in order to control the level of iodine vapor therein, thereby promoting arc stability and lamp performance, while extending lamp life.

The nickel silicide acts to getter oxygen available in the arc tube due to lamp processing steps, thereby suppressing the consumption of metal iodide and avoiding the formation of oxides and the concomitant release of free iodine in the arc tube.

The silver reacts with free iodine that has been released due to diffusion of metal from the metal iodide(s) of the fill into the arc tube wall, forming silver iodide (AgI). Under lamp operating conditions, some of the silver iodide vaporizes and some remains in the liquid phase. The vapor pressure of the silver iodide is determined by its liquid temperature which, in turn, is controlled by the power applied to the system. The iodine that is bound to silver in the liquid phase is not released to the vapor phase because silver iodide has a relatively high boiling point (1506° C.) and a relatively low vapor pressure. Hence, the total iodine concentration in the vapor phase is regulated by the liquid temperature only, and an excessive iodine buildup is avoided. Hence, with the iodine vapor pressure controlled below an arc instability threshold, arc stability is promoted and maintained.

The quantities of silver and nickel silicide employed to control iodine vapor pressure below an arc instability threshold are dependent upon such factors as type and quantity of fill ingredients, size and shape of the arc tube, excitation power and operating temperature. An exemplary quantity of silver is in the range from 0.4 to 2.5 milligrams (mg), a preferred quantity being in the range from 0.4 to 1.0 mg; and an exemplary quantity of nickel silicide is in the range from 0.05 to 0.5 mg, a preferred quantity being in the range from 0.05 to 0.12 mg.

EXAMPLE

Figure 2:
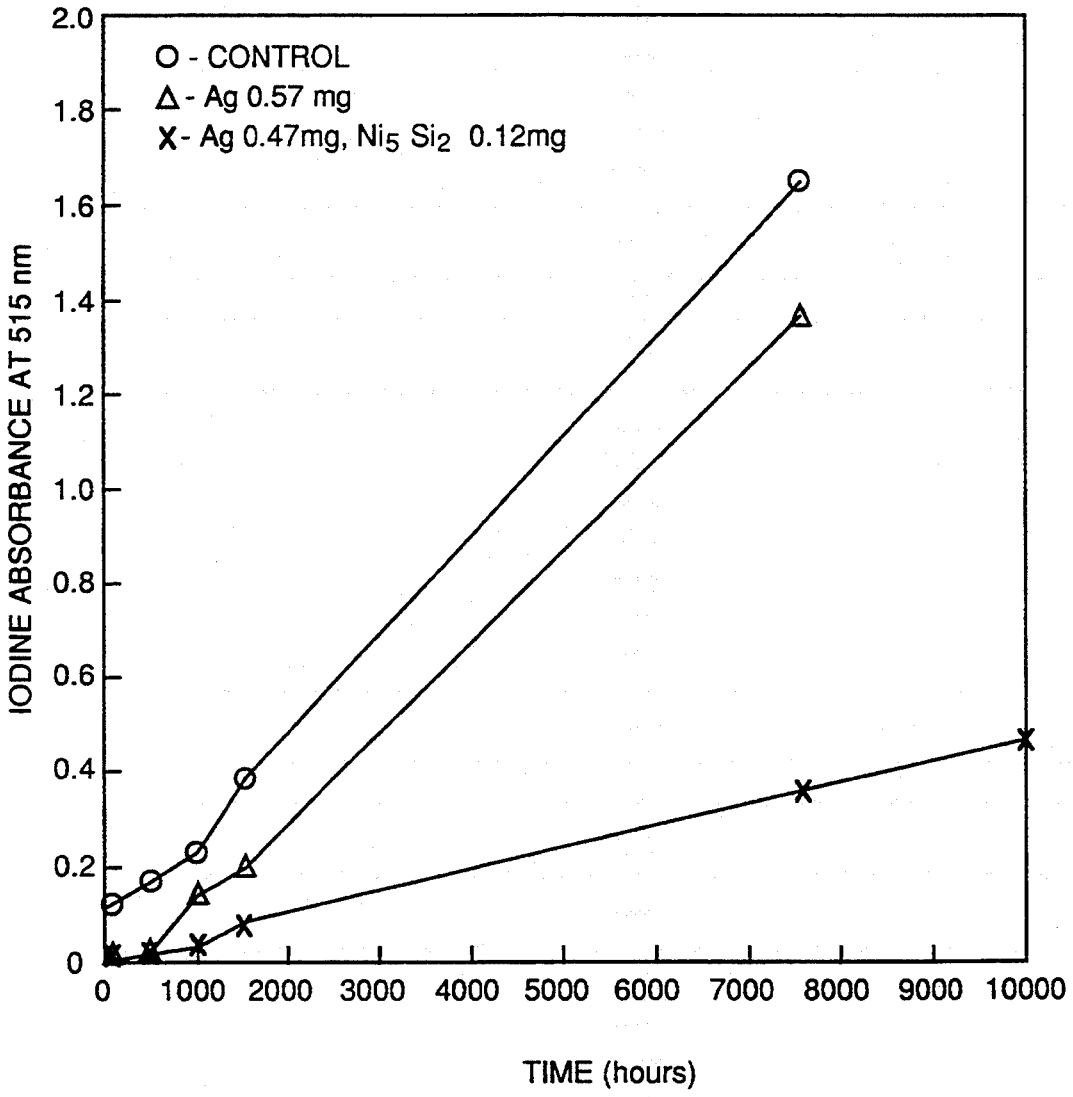
FIG. 2 graphically compares the iodine absorbance for electrodeless high intensity metal halide discharge lamps using: no getter; a silver getter only; and silver and nickel silicide getters in accordance with the present invention.

Electrodeless metal halide lamps using approximately 0.12 mg of a nickel silicide (e.g., $Ni_5Si_2$) and approximately 0.47 mg of silver metal (Ag) to regulate the iodine level therein were built and tested for 10,000 hours. The arc tubes were ellipsoid with dimensions 26 mm×19 mm. The nickel silicide was in the form of a chunk; and the silver was cut from silver wire. Similar lamps using neither nickel silicide nor silver metal, and similar lamps using only silver metal (approximately 0.57 mg) as a getter, were tested. The results are shown in FIG. 2. As indicated, a proper combination of nickel silicide and silver advantageously suppresses free iodine buildup.

Advantageously, therefore, use of nickel silicide as an oxygen getter and silver as an iodine getter in an electrodeless high intensity discharge lamp allows for control of the iodine vapor level below the arc instability threshold over a long period of time so that lamp life is improved and extended.

As an additional advantage, neither nickel silicide nor silver metal attack the quartz wall of the arc tube because silica ($SiO_2$) is much more stable than both nickel oxide (NiO) and silver oxide ($Ag_2O$). Also, silver iodide (AgI) and nickel iodide ($NiI_2$) are less stable than the iodides of the lamp fill, such as, for example, sodium iodide (NaI), cerium iodide ($CeI_3$), lanthanum iodide ($LaI_3$), neodymium iodide ($NdI_3$), praeseodymium iodide ($PrI_3$) and rhenium iodide ($ReI_3$), so that the addition of silver and nickel silicide to the arc tube does not accelerate the decomposition of the iodides of the fill which would otherwise enhance devitrification and etching of the quartz wall.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless high intensity discharge lamp, comprising:

a light-transmissive arc tube for containing a plasma arc discharge;

a fill disposed in said arc tube, said fill including at least one metal iodide;

an excitation coil situated about said arc tube for exciting said arc discharge in said fill; and silver metal and nickel silicide added to said fill in predetermined quantities for controlling the iodine vapor level during lamp operation to promote arc stability, said silver metal comprising an iodine getter and said nickel silicide comprising an oxygen getter.

2. The electrodeless high intensity discharge lamp of claim 1 wherein said at least one metal iodide is selected from a group of rare earth metal iodides consisting of: cerium iodide ($CeI_3$), lanthanum iodide ($LaI_3$), neodymium iodide ($NdI_3$), praeseodymium iodide ($PrI_3$), rhenium iodide ($ReI_3$), and any combination thereof.

3. The electrodeless high intensity discharge lamp of claim 1 wherein said at least one metal iodide is selected from a group of alkali metal iodides consisting of: sodium iodide (NaI), cesium iodide (CsI) and lithium iodide (LiI), and any combination thereof.

4. The electrodeless high intensity discharge lamp of claim 1 wherein said fill comprises at least one rare earth metal halide and at least one alkali metal halide.

5. The electrodeless high intensity discharge lamp of claim 1 wherein said predetermined quantity of silver is in a range from approximately 0.4 to 2.5 milligrams; and wherein said predetermined quantity of nickel silicide is in a range from approximately 0.05 to 0.5 milligrams.

6. The electrodeless high intensity discharge lamp of claim 5 wherein said predetermined quantity of silver is in a range from approximately 0.4 to 1.0 milligrams; and wherein said predetermined quantity of nickel silicide is in a range from approximately 0.05 to 0.12 milligrams.

* * * * *